United States Patent [19]

Juery

[11] 3,943,307

[45] Mar. 9, 1976

[54] PLURAL INTERLOCKING SLIDER CAMS ALLOWING SINGLE ACTUATOR AND MULTIPLE SWITCH OPERATION

[75] Inventor: Gerard Juery, Rueil Malmaison, France

[73] Assignee: La Telemechanique Electrique, France

[22] Filed: May 24, 1974

[21] Appl. No.: 473,051

[30] Foreign Application Priority Data

May 30, 1973 France ..... 73.19677

[52] U.S. Cl. ..... 200/5 E; 200/5 EA; 200/18; 200/50 C; 200/153 LA

[51] Int. Cl.[2] ..... H01H 9/26

[58] Field of Search..... 200/5 E, 5 EA, 5 EB, 17 R, 200/18, 50 C, 153 L, 153 LA; 74/483 PB

[56] References Cited

UNITED STATES PATENTS

| | | | |
|---|---|---|---|
| 2,639,337 | 5/1953 | Framhein | 200/18 X |
| 2,675,435 | 4/1954 | Framhein | 200/153 LA X |
| 2,748,205 | 5/1956 | Forstrom | 200/5 EA |
| 2,773,139 | 12/1956 | Forstrom et al. | 200/5 EA |
| 3,476,890 | 11/1969 | Powell | 200/5 EA |
| 3,487,178 | 12/1969 | Stout | 200/5 EA |

FOREIGN PATENTS OR APPLICATIONS

| | | | |
|---|---|---|---|
| 2,024,579 | 12/1970 | Germany | 200/50 C |

*Primary Examiner*—James R. Scott
*Attorney, Agent, or Firm*—William A. Drucker

[57] ABSTRACT

An electrical switch apparatus has a pair of first switches and a second switch each with a spring-loaded part for actuating its contacts. The switches are arranged in a casing in which two slides are movable against springloading in convergent paths. Each slide has first and second cams to engage with and move the actuators of a respective first switch and the second switch, the arrangement being such that when one slide has commenced to move in the switch-actuating direction, it blocks the path of the other slide, with the result that each slide can be moved to actuate a respective first switch and thereafter the second switch, but it is impossible for both of the first switches to be actuated at the same time.

4 Claims, 6 Drawing Figures

Figure 1:
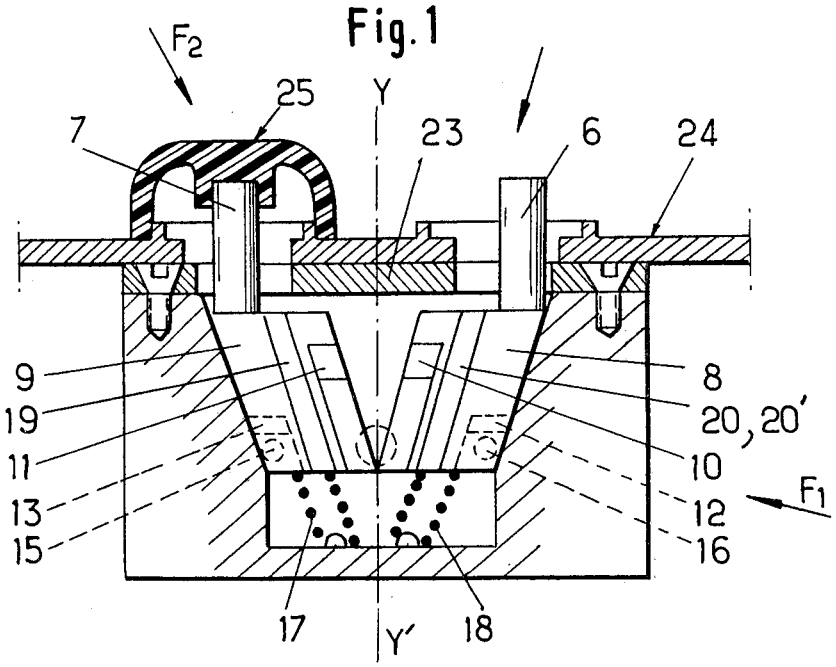

Fig. 3
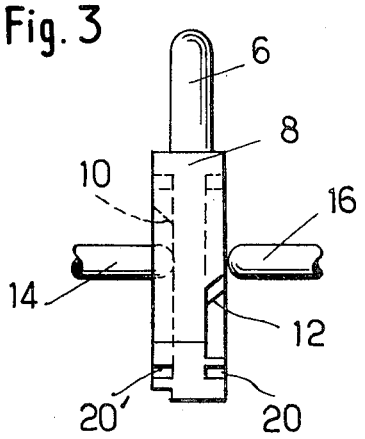
Fig. 4
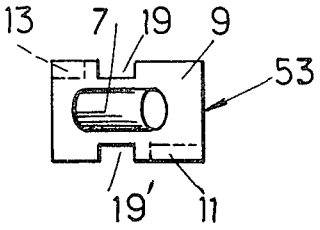
Fig. 5
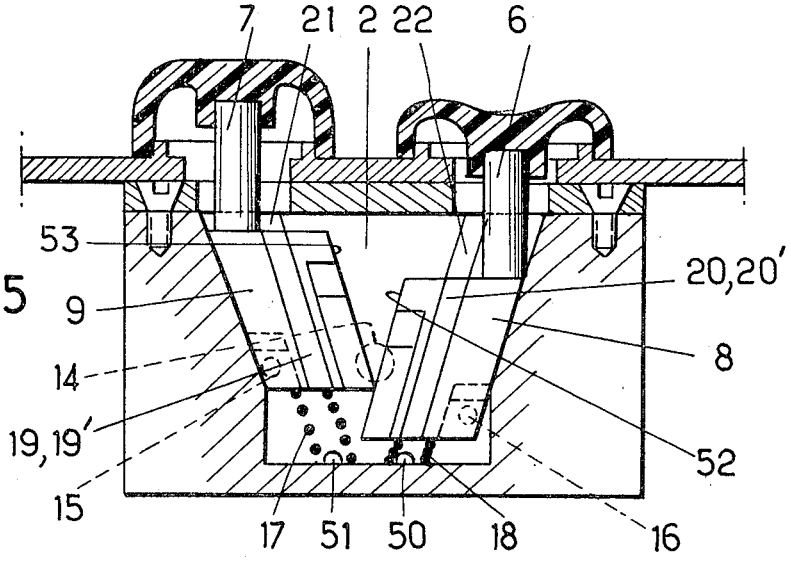
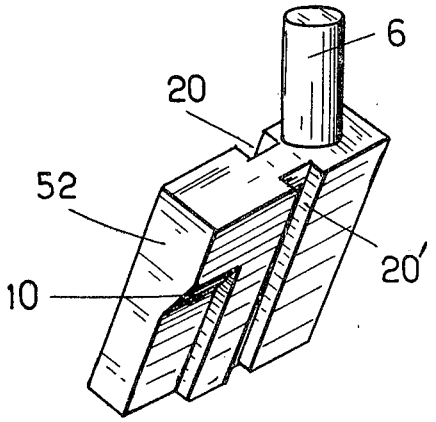
Fig. 6

PLURAL INTERLOCKING SLIDER CAMS ALLOWING SINGLE ACTUATOR AND MULTIPLE SWITCH OPERATION

The invention relates to a device to control, by means of two reciprocally locking push-buttons, three switches of which two can only be actuated separately by one of the two buttons during an initial fraction of its movement, while the third is actuated by either one of the buttons during an additional fraction of their movement.

Such devices are, e.g., well suited to controlling lifting equipment wherein a lifting motor has to be able to cause lifting and lowering movements, this at a normal speed or at high speed.

Devices capable of effecting the switching necessary to such control methods, in which reciprocal locking is effected electrically, are already known.

In other known devices each push-button is associated with two switches and operates them successively by causing the successive compression of the return springs of each switch.

The result is that the travel of the push-button has to be reduced in order not to press too hard on the switch which has been actuated first; this reduction of travel is reflected by uncertainty in assessing the travel to be given to the push-button in order to actuate one or both switches. Moreover, the pressure which has to be applied to the push-button is considerably increased when the two switches are actuated simultaneously so that holding the button in this position quickly tires the operator, which may be reflected by untimely release of the push-button. Finally, in view of the relative positions of the buttons and the switches, no increase of travel can be contemplated.

Also known are systems of locking two parts wherein the axes of movement of the two parts are convergent so that the movement of one of these parts towards the point of intersection of the axes prevents the movement of the other towards the same point. These systems are not, however, associated with switches with a view to effecting the desired switching.

The invention is therefore intended to provide a control device capable of effecting the desired switching, but in which the travel of the push-buttons can be increased without this increase being reflected by a variation in the same direction of the pressure to be applied, this by means of a suitable arrangement of the units making it possible at the same time to effect very safe mechanical locking and to impart a long travel to the operating units by the use of very flexible return spring parts.

In accordance with the invention, this result is achieved by the fact that on either side of the plane passing through the axes of movement of the push-buttons, arranged in the same housing containing the locking system and the return units, there are arranged on one side the two switches each associated with one of the push-buttons and on the other side the third switch, these three switches each being actuated by an actuating part whose movement is practically perpendicular to the said plane.

In an advantageous embodiment of the invention which provides a substantial saving of component parts and considerably reduces the operating pressure, the housing comprises two rectilinear guides whose directions converge, along which two slides, each associated with one of the push-buttons, can move alternately, each slide having on two opposite faces parallel to the plane, sloping surfaces designed to cause the movement of the parts actuating the switches which press against them.

Figure 2:
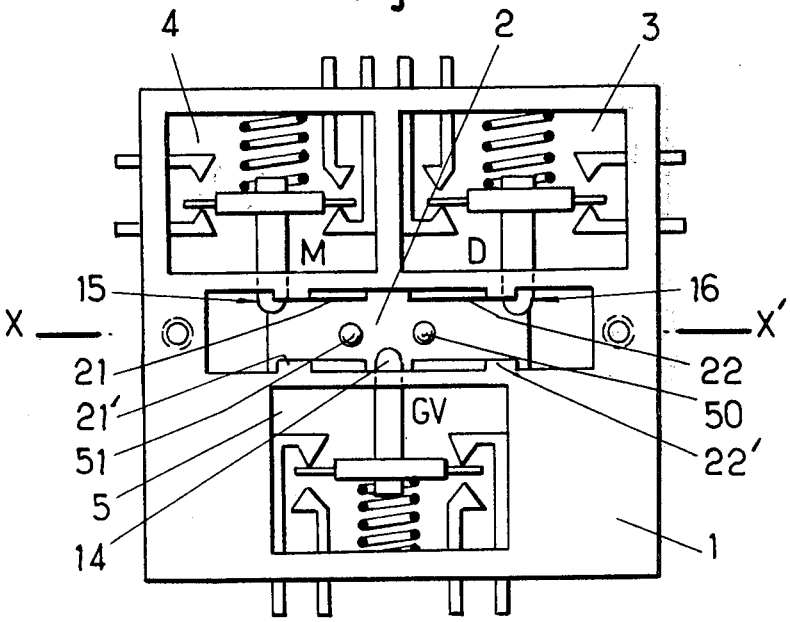

Other useful characteristics of the invention will emerge more clearly from the following description, which is illustrated by examples of embodiments showing:

FIG. 1, a sectional elevation view of the device along the plane XX′ in FIG. 2, FIG. 2, a view from above of the device in which the lid and the push-buttons have been removed, FIG. 3, a side view in direction $F_1$ of the slide associated with one of the push-buttons, FIG. 4, a view from above in direction $F_2$ of the same slide, FIG. 5 is a section of the device of FIG. 1, in which one of the push buttons is illustrated in its actuated position, FIG. 6 is a perspective view of a slide 8.

In FIG. 2, reference 1 indicates a casing 1 of a generally cubic shape in which, during moulding, a prismatic housing 2 has been formed, on each side of which are arranged three cavities 3, 4 and 5.

The two cavities 3 and 4 arranged on the same side of the perpendicular plane passing through the line XX′ which divides the housing 2 into equal parts, are each designed to take a quick-break switch indicated by D and M respectively. The first of these switches is designed to cause the starting of a lifting motor in the load-lowering direction, while the second is to cause the reverse movement, either by starting a different motor or by reversing the direction of rotation of the same motor. It is therefore necessary for it to be impossible for these two switches to be actuated simultaneously.

In cavity 5 there is a third switch, indicated by GV, which is to cause the switching in of a circuit which will be common to both motors, or will be the only circuit, designed to cause an increase in the speed of the lifting motor when it is actuated.

This switch GV will therefore be used when one of the two switches D or M has already been actuated.

It will be seen in FIG. 2 that each of the three switches D, M, GV is fitted with an actuating part 16, 15 and 14 respectively; these actuating parts go through the walls separating the cavities 3, 4 and 5 from the housing 2 and come to protrude slightly inside the latter.

FIG. 1 shows at 2 (note FIG. 2) the same housing and the rest of the device seen in section along the line XX′.

Two push-buttons 6 and 7 are provided to cause the switching necessary to control the lifting equipment.

Each of the push-buttons 6 and 7 is integral with a slide 8 and 9 respectively which can slide in the housing 2 by virtue of a guide system consisting, e.g., of grooves 20, 20′ and 19, 19′ respectively, integral with the slides, cooperating with ribs 22, 22′ and 21, 21′ respectively, arranged inside the housing 2, see also FIG. 4.

Each of these slides is subjected to the action of a return spring 18 and 17 respectively which bears upon nipples 50, 51 of the bottom of the casing 1 and extends to move the slide upwards when in its "at rest" position.

The limits to the possible movement of the two slides are fixed by the guide systems, whose directions converge. The result is that when the respective portions 52, 53 of one of the slides 8, 9 is moved towards the point of convergence of the guides it will not be possible to move the other towards the same position and consequently simultaneous actuation of the push-buttons will be prevented by this mechanical locking. FIG. 6 shows how the depressed portion of the slide 8 prevents a movement of the other slide 9, and conversely.

Besides the guide units which have just been described, each slide 8, 9 comprises on two opposite faces, parallel to the plane passing through the housing, sloping cam surfaces 10, 12 and 11, 13 respectively, designed to cause the movement of the parts 14, 15, 16 actuating the switches, see also FIG. 3.

Thus actuating part 16 will be engaged by sloping surface 12 opposite which it will be placed in a first fraction of the travel of the push-button and actuating part 14 will, in an additional fraction of the travel of the slide, be pushed in by sloping surface 10.

The direction of movement of actuating parts 16 and 14 will be close to perpendicular to the middle plane passing through XX'.

As the switches are quick-break switches only needing a slight movement in order to switch, the pressures to apply to the button will not be high and will be limited to the moment when the sloping surfaces are actually in action.

In view of the fact that no mechanical locking or electric switching part is positioned in the extension of the travel of the slides, it has been possible to make the return springs long ones, which gives them high flexibility and allows the slides to have a long travel. No fatigue other than that caused by the compression of a very flexible spring will therefore be experienced by the operator.

The working of slide 9 associated with push-button 7 is similar to the one which has just been described.

As each of the push-buttons must be able to actuate, during the second fraction of its travel, the same switch GV, the part 14 actuating the latter will be placed in an area close to the plane YY' bisecting the two directions defined by the guide systems and at a height determined by its width and the width of the sloping surfaces 10 and 11 so as to be able to be engaged by one only of these sloping surfaces.

When all the moving parts are arranged in the housing 2, a lid 23 is placed over the top of the casing 1 to serve as a stop for the slides. This lid 23 is provided with two openings designed to allow the operating units 6 and 7 of the push-buttons to protrude outside.

FIG. 1 shows that the axes of these operating units 6 and 7 are not parallel to the directions of movement of the slides, but are parallel to the bisecting plane YY' and contained in the middle plane XX'.

This arrangement makes it possible to fix the device as a whole on to a plate 24 forming part e.g. of a pendant push-button box currently used in lifting systems as it has thus made it possible to present obliquely actuated push-buttons in the form of push-buttons actuated perpendicularly to the surface of the plate 24.

A cup made of a flexible and elastic material 25 the inside part of which is fitted over the operating unit such as 7 and the periphery of which is fixed to the plate, provides a seal without allowing any wear to be caused by the lateral component of the movement to which said unit is subjected.

What is claimed is:

1. Electrical switch apparatus comprising:
   - i. a casing
   - ii. a pair of first switch means and a second switch means disposed in said casing, each of said switch means including:
     - a. electrical contacts
     - b. an actuating part for actuating said contacts
     - c. means resiliently loading said actuating part into a rest position
   - iii. first and second slides
   - iv. interengaging guide means respectively on said first and second slides, said guide means being positioned such that said first and second slides have convergent paths, said first and second slides being arranged such that when one said slide has commenced to move from a rest position towards an actuated position it moves into the path of the other slide and prevents movement of said other slide away from rest position
   - v. means resiliently urging said first and second slides towards rest position
   - vi. first and second cam means on each said slide, said cam means being spaced in the direction of movement of the slide, the actuating parts of the first switch means being disposed in the path of travel of the first cam means and the actuating part of the second switch means being disposed in the path of travel of the second cam means, whereby during movement of said slide from rest position to actuated position the first said cam means engages with and moves said actuating part of a respective first switch means and thereafter the second said cam means engages with and moves said actuating part of said second switch means.

2. Electrical switch apparatus, as claimed in claim 1, wherein said interengaging guide means are rectilinear ribs on said casing engaging in rectilinear grooves in said slides.

3. Electrical switch means, as claimed in claim 1, wherein said actuating part of said second switch means has a central longitudinal axis parallel to which it is moved by the second cam means, said axis lying in a plane bisecting the angle defined by the convergent paths of the slides.

4. Electrical switch means, as claimed in claim 1, further comprising:
   - vii. a respective push button integrally mounted on each slide, said push button having a longitudinal axis, said axes of said push buttons being parallel to each other and to a plane bisecting the angle defined by the convergent paths of said slide members.

* * * * *